US006287368B1

(12) United States Patent
Ilmasti

(10) Patent No.: US 6,287,368 B1
(45) **Date of Patent: *Sep. 11, 2001**

(54) APPARATUS FOR THE PURIFICATION OF AIR FLUE GASES, OR EQUIVALENT

(75) Inventor: Veikko Ilmasti, Helsinki (FI)

(73) Assignee: Oy Airtunnel Ltd. (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/898,248

(22) Filed: Jul. 22, 1997

Related U.S. Application Data

(63) Continuation of application No. 07/993,498, filed on Dec. 18, 1992, now abandoned, which is a continuation of application No. 07/407,964, filed on Sep. 14, 1989, now abandoned.

(30) Foreign Application Priority Data

Aug. 25, 1989 (FI) ..... 893998

(51) Int. Cl.[7] ..... B03C 3/68

(52) U.S. Cl. ..... 96/19; 95/4; 95/6; 96/22; 96/80; 96/97; 323/903; 361/231; 361/233

(58) Field of Search ..... 96/18, 19, 22, 96/95–100, 80–82; 361/233, 231; 323/903; 95/2–7, 57

(56) References Cited

U.S. PATENT DOCUMENTS

| | | | | |
|---|---|---|---|---|
| 1,357,202 | * | 10/1920 | Nesbit | 96/75 |
| 2,097,233 | * | 10/1937 | Meston | 361/233 X |
| 2,868,318 | * | 1/1959 | Perkins et al. | 96/94 |
| 3,561,253 | * | 2/1971 | Dorman | 55/270 X |
| 3,582,711 | * | 6/1971 | Jahnke | 361/231 |
| 3,668,836 | * | 6/1972 | Richardson et al. | 96/66 |
| 3,695,001 | * | 10/1972 | Watanabe | 95/78 |
| 3,745,749 | * | 7/1973 | Gelfand | 96/21 |
| 3,765,153 | * | 10/1973 | Grey | 96/48 |
| 4,185,971 | * | 1/1980 | Isahaya | 96/40 |
| 4,194,888 | * | 3/1980 | Schwab et al. | 95/78 |
| 4,218,225 | * | 8/1980 | Kirchhoff et al. | 96/32 |
| 4,284,417 | * | 8/1981 | Reese et al. | 95/3 |
| 4,657,738 | * | 4/1987 | Kanter et al. | 422/186.4 |
| 4,689,056 | * | 8/1987 | Noguchi et al. | 96/79 |
| 4,765,803 | * | 8/1988 | Hirth | 95/80 |

FOREIGN PATENT DOCUMENTS

| | | | |
|---|---|---|---|
| 526021 | * | 6/1931 | (DE) . |
| 850598 | * | 9/1952 | (DE) . |
| 1963715 | * | 6/1971 | (DE) . |
| 0271457 | * | 6/1988 | (EP) . |

(List continued on next page.)

OTHER PUBLICATIONS

Kirk–Othmer, *Encyclopedia of Chemical Technology*, Third Edition, vol. 1, John Wiley and Sons, New York, pp. 673–685, 1978.*

(List continued on next page.)

*Primary Examiner*—Richard L. Chiesa

(57) ABSTRACT

Apparatus for the purification of air, flue gases in which apparatus the air, flue gases or equivalent are directed into a duct, in which apparatus the air, flue gases are ionized, and in which apparatus charged impurity particles (7) present in the air, flue gases or equivalent are attracted by one or more collector surfaces (2) by virtue of a difference in the states of charge, causing the particles to settle on the surface. The air, flue gases are ionized by virtue of one or more ionizing electrodes (5) directed at a collector surface. The distance between the ionizing electrode or equivalent and the collector surface and the difference between the state of electric charge of the collector surface and the charged impurity particles are so adjusted that the impurity particles will move essentially directly towards the collector surface and settle on it.

1 Claim, 5 Drawing Sheets

FOREIGN PATENT DOCUMENTS

| | | | | |
|---|---|---|---|---|
| SE 8501858-8 | * | 6/1985 | (FI) . | |
| SE501858-8 | | 6/1985 | (FI) . | |
| SE87501858-8 | | 10/1985 | (FI) . | |
| 737734 | * | 9/1955 | (GB) . | |
| 848446 | * | 9/1960 | (GB) | 55/152 |
| 1238438 | | 7/1971 | (GB) . | |
| 1238438 | | 7/1991 | (GB) . | |
| 848446 | * | 9/1996 | (GB) . | |
| 51-14180 | * | 5/1976 | (JP) . | |
| 52-48352 | * | 12/1977 | (JP) . | |
| 53-1514 | * | 1/1978 | (JP) . | |
| 107759 | * | 5/1988 | (JP) | 55/106 |
| 63-107759 | * | 5/1988 | (JP) . | |
| 1375342 | | 2/1988 | (RU) . | |
| 1375342 | * | 2/1988 | (SU) . | |

OTHER PUBLICATIONS

Bump, Robert L., *Chemical Engineering*, "Electrostatic Precipitators in Industry", pp. 129–136, Jan. 17, 1977.*

Search Report of European Patent Application No. 90850276.8, Dated May 2, 1994.*

*Electrostatic Precipitation* by Senichi Masuda and Shunsuke Hosokawa (date unknown, pp. 441–479).

*A New Air Cleaning Device for a Sintering Plant* by T. Nordman et al. (date unknown, 4 pages).

*World Filtration Congress 8*, Ion Blast—air purification (date unknown, 6, pages).

*Chemical Engineering*; Jan 17, 1977; pp. 129–136; "Electrostatic Precipitators in Industry".

* cited by examiner

APPARATUS FOR THE PURIFICATION OF AIR FLUE GASES, OR EQUIVALENT

This is a Continuation of application Ser. No. 07/993,498, filed Dec. 18, 1992 which in turn is a continuation of Ser. No. 07/407,964, filed Sep. 14, 1989, both now abandoned.

BACKGROUND AND SUMMARY OF THE INVENTION

The present invention concerns a procedure and an apparatus for the purification of air, flue gases or equivalent, in which procedure the air, flue gases or equivalent are directed into a duct or equivalent, in which procedure the air, flue gases or equivalent are ionized, and in which procedure charged impurity particles present in the air, flue gases or equivalent are attracted by one or more collector surfaces by virtue of a difference in the states of charge, causing the particles to settle on said surface(s).

GB-patent publication 1 238 438 proposes a procedure and an apparatus for the removal of dust particles from the air in a tunnel. In the procedure presented in the publication mentioned, the tunnel is provided with electrodes, to which a high voltage is applied. The electrodes charge the particles in the air in the tunnel by producing an electric field between the interior wall of the tunnel and the electrodes. Thus the charged dust particles are attracted to the interior walls of the tunnel. For the air to be sufficiently purified, it has to be very strongly ionized in order that all particles in the tunnel should be charged and attracted to the tunnel wall. Moreover, several electrodes and a long tunnel are needed.

The object of the present invention is to eliminate the drawbacks mentioned. The procedure of the invention for the purification of air, flue gases or equivalent is characterized in that the air, flue gases or equivalent are ionized by means of one or more ionizing electrodes directed at a collector surface, and that the distance between the ionizing electrode or equivalent and the collector surface as well as the difference between the states of electric charge of the collector surface and the charged impurity particles are so adjusted that the impurity particles will move essentially directly towards the collector surface and settle on it.

The preferred embodiments of the invention are presented in the other claims.

The invention provides the following advantages over current methods:

Efficient purification even in a short duct. Considerable reduction in energy consumption as compared to current procedures. The need for maintenance is reduced as the collector surfaces can be washed simply with a water jet.

Air can be purified regarding different particle sizes down to pure gases. The invention makes it possible to remove particles as small as 0.005 $\mu$m and even smaller.

In the following, the invention is described in greater detail by the aid of examples with reference to the drawings attached, in which

DESCRIPTION OF PREFERRED EMBODIMENTS

Figure 1:
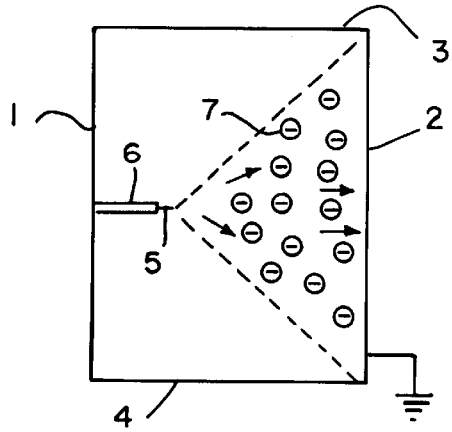
FIG. 1 illustrates air purification in a duct by the procedure of the invention.

FIG. 1 presents a duct which has side walls 1 and 2, a ceiling 3 and a floor 4. The fresh air supplied into a building or the air to be re-circulated is directed into the duct for removal of impurity particles. For purification, the air is ionized by means of an ionizing electrode 5 consisting e.g. of a thin metal wire, which is mounted on a bracket 6 and connected with a cable to a voltage supply unit, which will be described later. The ionizing electrode 5 is directed at the opposite side wall 2, which is earthed and acts as a particle-collecting surface. The voltage applied to the ionizing electrode 5, which is of the order of 100–250 kV, and the distance between the ionizing electrodes and the side wall are so adjusted that a conical ion beam or ion jet as indicated by the broken lines is produced. With this arrangement, the (negatively) charged impurity particles 7 will move directly to the side wall 2 and settle on it due to the difference in electric charge between the particles and the wall. The ion jet can be felt near the wall as a cool ion current. The distance between the ionizing electrode and the collecting wall is typically 100–1000 mm.

Figure 2:
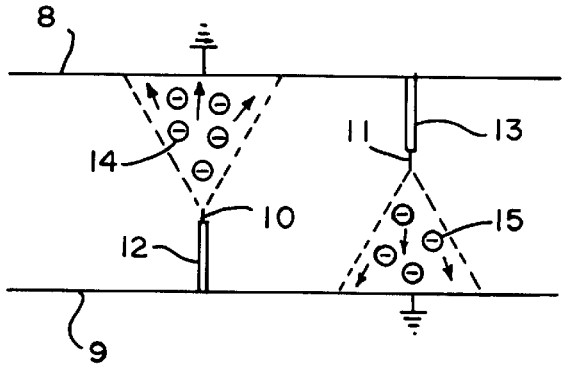
FIG. 2 also illustrates air purification in a duct by the procedure of the invention.

FIG. 2 shows a top view of a duct with earthed side walls 8 and 9 and two ionizing electrodes 10 and 11 mounted on brackets 12 and 13. This arrangement allows a more efficient purification of the air as the first electrode 10 produces a conical ion beam causing impurity particles 14 to move towards wall 8 and settle on it while the second electrode 11 produces an ion beam causing impurity particles 15 to move to the opposite wall 9, so that the air is efficiently purified over the whole sectional area of the duct.

Figure 3:
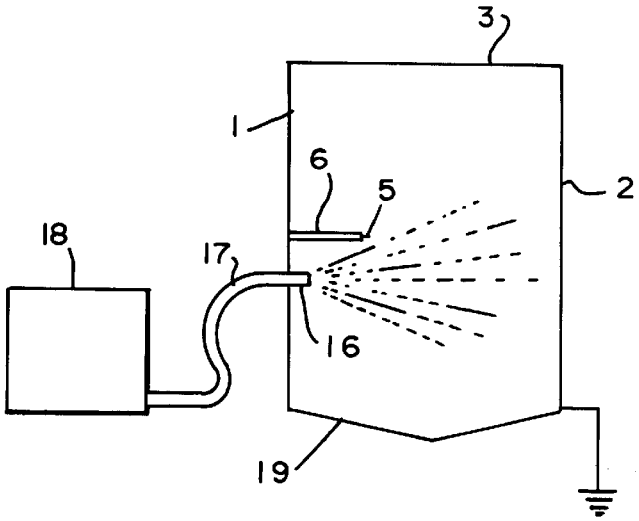
FIG. 3 illustrates the cleaning of a wall acting as a collector surface.

FIG. 3 illustrates the cleaning of the collector surface 2 using a water jet. The water is sprayed onto the surface through a nozzle 16, to which it is supplied via a hose 17 from a container 18. The duct floor 19 is V-shaped, so that the water is gathered in the middle of the floor, from where it can be directed further e.g. into a drain.

Figure 4:
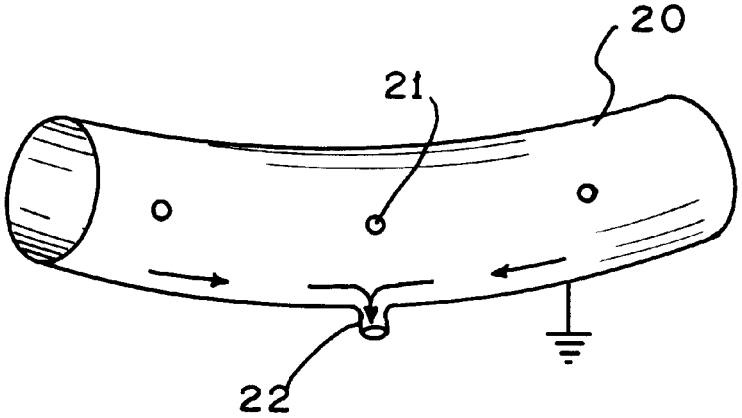
FIG. 4 shows a tube used for air purification.

FIG. 4 shows a tubular purification duct 20 with ionizing electrodes 21. The duct has a curved shape such that the cleaning water will flow out through an exit opening 22 as indicated by the arrows.

Figure 5:
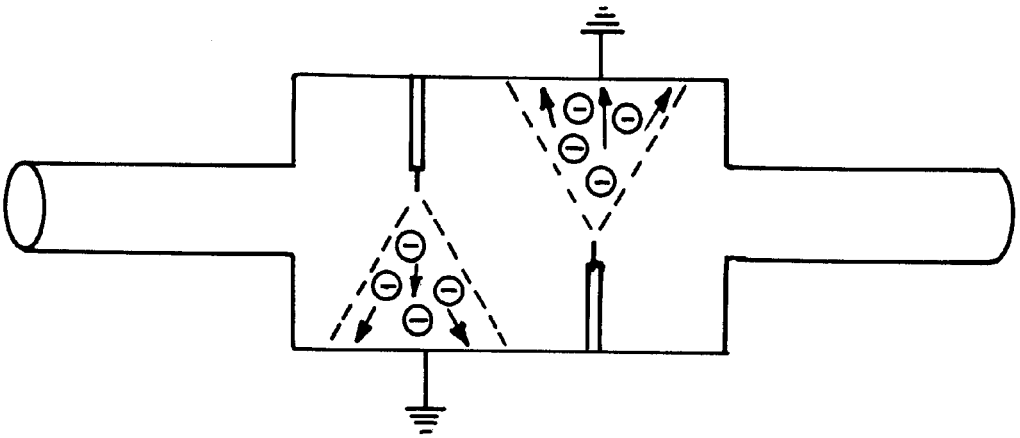
FIG. 5 shows an expanded tube used for air purification.
Figure 6:
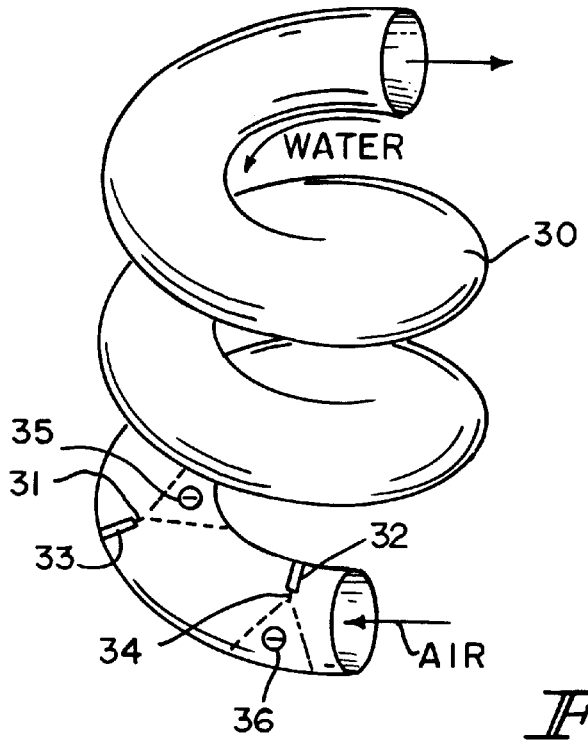
FIG. 6 shows a spiral tube.

FIG. 5 shows a tubular purification duct 22 provided with an expansion 23 to retard the flow of air through it, the walls of the expanded part acting as collecting surfaces. The expanded part is provided with ionizing electrodes 24 and 25 mounted on brackets 26 and 27 on opposite walls. The impurity particles 28 and 29 drift towards the collecting surfaces as explained above. FIG. 6 presents a spiral tube 30 with ionizing electrodes 31 and 32 mounted on brackets 33 and 34. The impurity particles settle on the earthed wall of the tube 30. The water used for cleaning the spiral tube exits through the lower end as indicated by the arrows.

Figure 7:
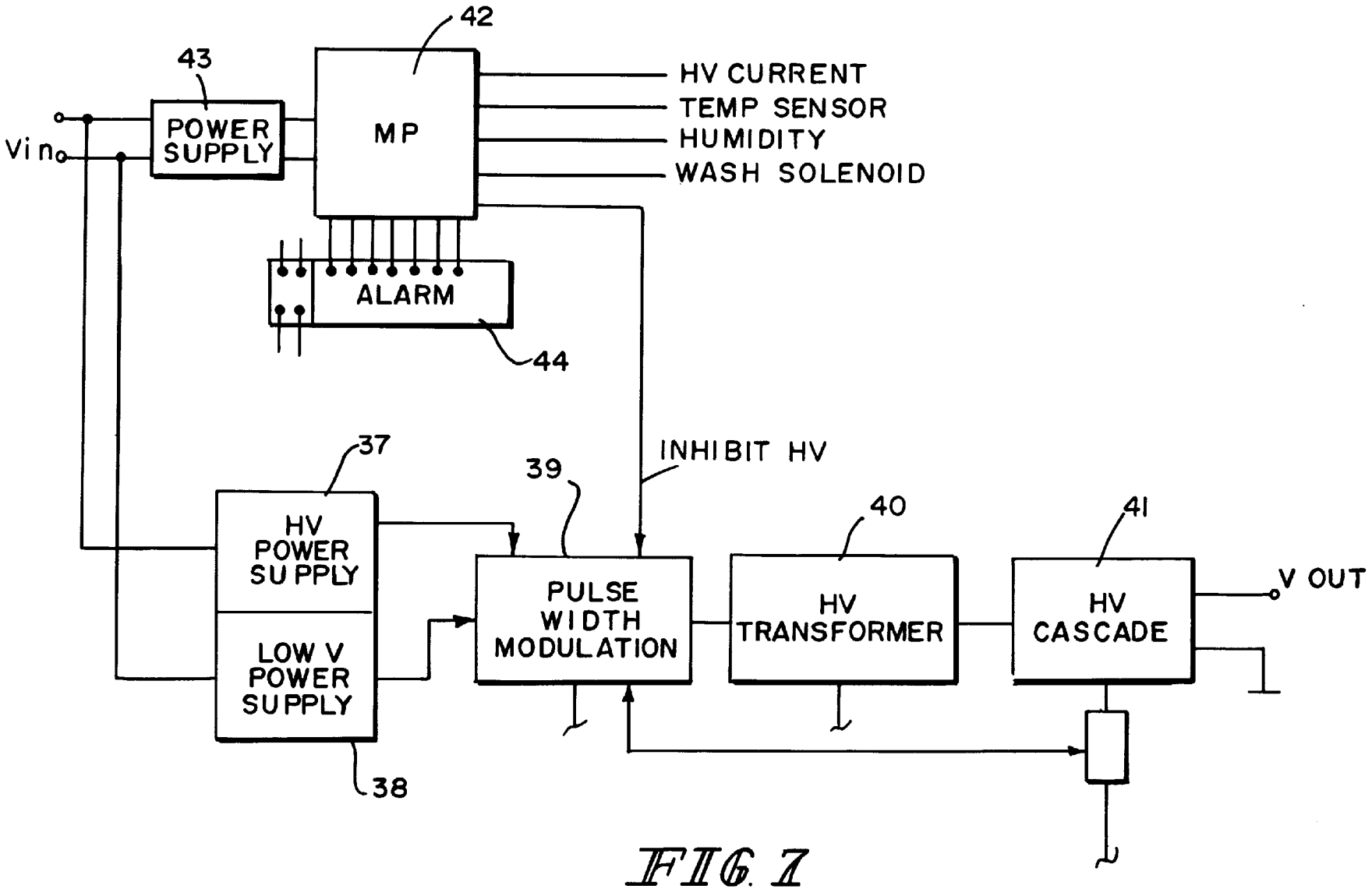
FIG. 7 shows a schematic diagram of a power supply unit for use with the present invention.

FIG. 7 shows a diagram of the power supply unit, which supplies a voltage to the ionizing electrodes. The unit comprises high-voltage and low-voltage units 37 and 38, which are fed by the mains voltage $V_{in}$, e.g. 220 V. The high-voltage and low-voltage units control a pulse-width modulator 39. The output of the pulse-width modulator is connected to the primary side of a high-voltage transformer 40, and the transformer output is connected to a high-voltage cascade 41, whose output voltage $V_{out}$ is applied to the ionizing electrodes. The mains voltage also feeds the power supply 43 of a microprocessor 42. Connected to the microprocessor are sensors for the ionizing current, duct temperature and humidity and a solenoid controlling the spraying of wash water through the nozzle. The sensors give an alarm in the form of a signal light in an alarm unit 44 and also an inhibit signal to the modulator, preventing the supply of voltage to the ionizing electrodes. The output voltage $V_{out}$ is adjusted by means of a regulating element 45.

Figure 8:
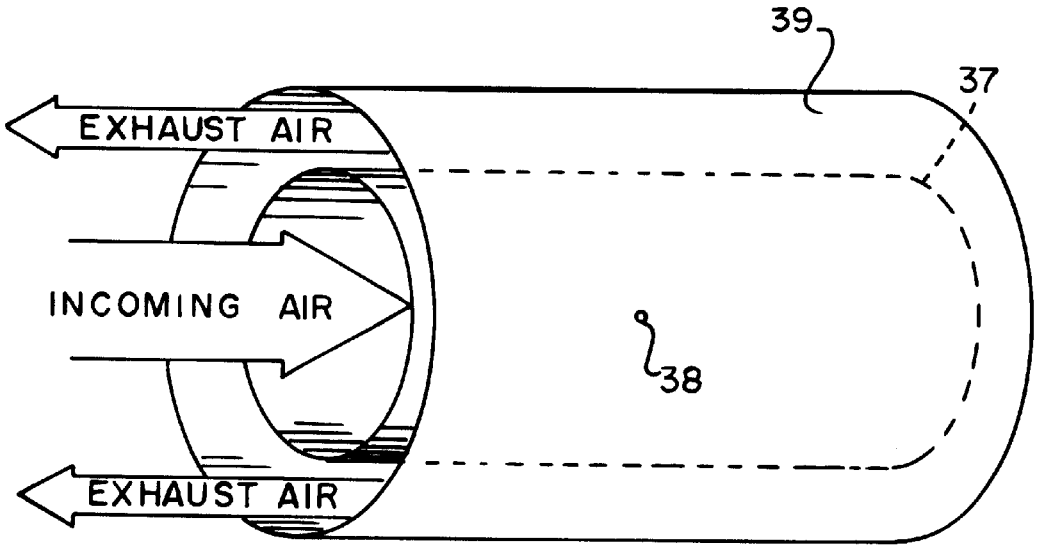
FIG. 8 shows a structure for air intake and air outlet.

FIG. 8 presents a tubular duct 37 for intake air, provided with an ionizing electrode 38 in the manner described above. The purification duct 37 is surrounded by an exit air duct 39, so that the action of the structure resembles that of a heat exchanger.

Figure 9:
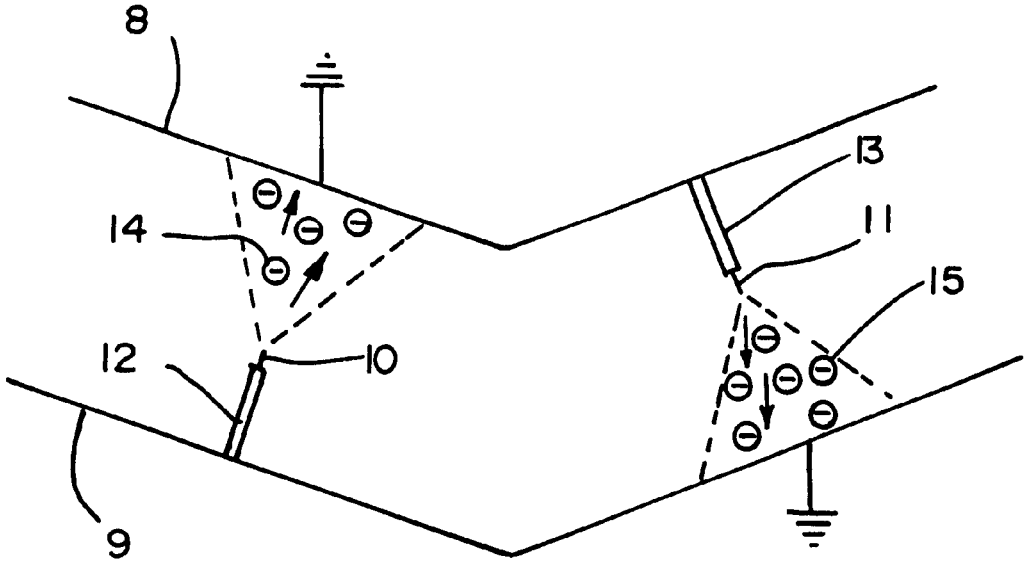
FIG. 9 illustrates also air purification in a duct.

Each section may be placed at an angle relative to the preceding section to create an arrangement where the impurity particles are more likely to collide against the walls and stick to them (FIG. 9). Also a guide plate may be used in the same manner.

It is obvious to a person skilled in the art that different embodiments of the invention are not restricted to the examples described above, but that they may instead be varied within the scope of the following claims. Instead of earthed collector surfaces, it is also possible to use collector surfaces having a charge of opposite sign in relation to the ions.

What is claimed is:

1. An apparatus for purification of gases, comprising:

a duct for receiving gases flowing therethrough, said duct including a collector surface on an interior wall portion of said duct, an emitter means, mounted on another interior wall portion of said duct at a distance in the range of 100–1000 mm from said collector surface, for creating an ion jet toward said collector surface, said emitter means, including a thin metal wire, one end of which is directed toward said collector surface, and said ion jet commencing from that end in a substantially conical shape toward said collector surface, the distance and relative electric charge between said collector surface and said emitter means being established such that impurities of the size range from smaller than 0.005 $\mu$m to 0.1 $\mu$m and up present in the gases flowing through said duct are carried at substantially a right angle toward and settle on said collector surface by said ion jet at a collection efficiency which remains high for all of the said impurity size ranges, said collector surface extending for less than the entire cross-sectional perimeter of said duct, wherein a sufficiently high voltage of 100 KV or more is applied to said emitter means so as to cause ion impact upon said impurities to cause said impurities to move in the direction of said collector surface, in addition to causing electrical attraction of said impurities to said collector surface so as to retain said impurities on said collector surface, and means for producing a high voltage supply of power to said emitter means and a supervision unit which is electrically connected to the means for supplying that power in order to interrupt the supply of power when any of the humidity, temperature or current to the ionizing electrode is out of a predetermined range.

* * * * *